US007290609B2

(12) United States Patent
Wardlaw et al.

(10) Patent No.: US 7,290,609 B2
(45) Date of Patent: Nov. 6, 2007

(54) SUBTERRANEAN WELL SECONDARY PLUGGING TOOL FOR REPAIR OF A FIRST PLUG

(75) Inventors: Louis J. Wardlaw, Houston, TX (US); Jack Michael Fraelick, Alvin, TX (US); Manuel Eduardo Gonzalez, Kingwood, TX (US); Robert B. Carpenter, Sugar Land, TX (US)

(73) Assignee: Cinaruco International S.A. Calle Aguilino de la Guardia, Panama I (PA)

( * ) Notice: Subject to any disclaimer, the term of this patent is extended or adjusted under 35 U.S.C. 154(b) by 275 days.

(21) Appl. No.: 10/924,055

(22) Filed: Aug. 20, 2004

(65) Prior Publication Data

US 2006/0037748 A1 Feb. 23, 2006

(51) Int. Cl.
*E21B 29/00* (2006.01)
*E21B 33/12* (2006.01)
*E21B 33/13* (2006.01)

(52) U.S. Cl. ..... 166/277; 166/192; 166/387

(58) Field of Classification Search ..... 166/277, 166/285, 286, 287, 288, 290, 292, 293, 299, 166/300, 250.14, 256, 101, 376, 57, 63, 164, 166/192, 142, 141, 181, 185, 186
See application file for complete search history.

(56) References Cited

U.S. PATENT DOCUMENTS 2,191,783 A * 2/1940 Wells ..... 166/300
2,286,075 A * 6/1942 Evans ..... 166/58
2,695,064 A * 11/1954 Ragan et al. ..... 166/63
2,775,302 A * 12/1956 Kirkpatrick ..... 166/310
2,942,668 A * 6/1960 Maly et al. ..... 166/185
RE25,846 E * 8/1965 Campbell ..... 166/122
3,760,877 A * 9/1973 De Lajarte et al. ..... 166/164
4,665,992 A * 5/1987 Franc ..... 166/387
4,976,307 A * 12/1990 Hall et al. ..... 165/76
5,052,489 A * 10/1991 Carisella et al. ..... 166/297
5,346,014 A * 9/1994 Ross ..... 166/297
5,611,400 A * 3/1997 James et al. ..... 166/293
5,613,557 A * 3/1997 Blount et al. ..... 166/277
5,810,085 A * 9/1998 James et al. ..... 166/292
5,833,001 A * 11/1998 Song et al. ..... 166/287
6,102,120 A * 8/2000 Chen et al. ..... 166/287
6,474,414 B1 * 11/2002 Gonzalez et al. ..... 166/277
2003/0141063 A1 * 7/2003 Haugen et al. ..... 166/297
2006/0144591 A1 * 7/2006 Gonzalez et al. ..... 166/277

* cited by examiner

*Primary Examiner*—Jennifer Gay
*Assistant Examiner*—David Andrews
(74) *Attorney, Agent, or Firm*—Beirne, Maynard & Parsons, L.L.P.

(57) ABSTRACT

A secondary plugging tool is disclosed for use in a subterranean plug, such as in a plugged and/or abandoned well. The repaired plug may be of a cementicious material, or a mechanically, hydraulically or electrically set plug or packer. The plugging tool includes an outer housing containing an eutectic metal alloy. A thermitic reaction charge is contained within chambers within an inner tubular member and a lower housing. The lower end of the outer housing being ported circumferentially there around, the thermitic reaction charge activates the eutectic metal charge such that the eutectic charge melts and pours out of the outer housing and across and upon the initial plug to repair any failure areas therein.

12 Claims, 2 Drawing Sheets

SUBTERRANEAN WELL SECONDARY PLUGGING TOOL FOR REPAIR OF A FIRST PLUG

BACKGROUND OF THE INVENTION (1) Field of the Invention

The invention relates to an apparatus and method for the repair of failure areas in a previously set plug within a subterranean well.

(2) Brief Description of the Prior Art

Subterranean wells, such as oil, gas or water wells, are required to be "plugged" when they are abandoned, to assure that any slow flow of hydrocarbons or other fluids within the well do not escape and flow to the top surface of the well. As used herein the term "first plug" is intended to include such conventional plugs as hydraulically set, or mechanically set, or electrically set plugs, bridge plugs, packers and the like, as well as the use of cementious material, alone, or in combination with such other first plugs, as herein described, as typically used to plug off a well or zone in a well to be temporarily or permanently abandoned. These first plugs are many times intended to properly secure the well and prevent any flow of any fluids from within the well to the top of the well or into other formations within the well. Over time, and after exposure to high temperatures and pressures in the well, as well as a corrosive and acidic environment in the well, failures in such plugs occur, as the result of leaks, metallic pitting, loss of elastomeric seal integrity, and the like. It therefore becomes necessary to either mill out the first plug and provide a replacement plugging means of some sort or set additional cement plugs. These procedures are, of course, expensive and time consuming.

U.S. Pat. No. 6,474,414, entitled "Plug For Tubulars" is directed to the use of moltenl solder for providing a plug in a subterranean well which may be poured or otherwise applied directly upon a platform for the molten solder in the well.

U.S. Pat. No. 6,536,349, entitled "Explosive System For Casing Damage Repair" illustrates the use of liquid explosives to fragment damaged casing which has become an obstruction to proper flow of the well.

The present invention addresses problems, as above described.

SUMMARY OF THE INVENTION

The present invention provides a secondary plugging tool for use in a subterranean well for the repair of a first plug previously introduced into and set within the well. The plugging tool comprises an outer tubular housing including a ported lower end. The ports in the ported end may be initially closed by means of a thinner outer portion of the housing which also melts to open the ports during the ignition of the tool, or by a series of meltable eutectic plugs. Alternatively, small, open ports may be provided circumferentially around and immediate the lower end of the outer tubular housing. An inner tubular housing is concentrically positioned within the outer tubular housing. A low temperature melting eutectic metal alloy charge is deposited within the outer tubular housing. A thermitic reaction charge is deposited within the inner tubular housing immediate and covering the ported end. The thermitic reaction charge is also provided in a chamber in a lower housing member selectively and releasably secured to the outer tubular housing. The thermitic reaction charge in the chamber in the lower housing is provided to bake/melt the eutectic metal alloy charge after it is decanted from the upper chamber. Means are secured to at least one of the said housings for introducing, positioning and retrieving the plugging tool.

The igniting charge may be ignited by percussion means, such a dropping of a bar, or by electric signal or other known means.

In lieu of using a separate inner housing for purposes of receiving the thermitic reaction charge, the thermitic reaction charge and the eutectic metal alloy charge may be placed into one housing and separated simply by use of cardboard or plastic tubes or sheets, or the like. In such an arrangement, the thermitic reaction charge would be placed into an interior section, and exteriorally surrounded by the low temperature melting eutectic charge. Ports or port means are provided around the lower end of the housing for permitting flow of the molten eutectic charge upon melting of the eutectic.

The secondary plugging tool of the present invention may be introduced into the well and withdrawn there from on wire line, cable, electric line, or tubing. If it is desired that the secondary plugging tool not be retrieved from the well subsequent to use, it may be left in the well by providing a release mechanism, such as a shear release between the top of inner and outer housings and the line, cable, or tubing used to introduce the tool within the well. Alternatively, the now empty inner and outer tubular members may be separated from the lower housing by providing a releasing means, such as a shear pin connection, between the lowermost end of at least one of the outer tubular housing and the top of the lower housing. When the method is completed, the line, cable, or tubing is pulled until the shear pin mechanism shears and separates the inner and outer housings from the lower housing, and the line or cable or tubing may be retrieved from the well with the lower housing left in the well

DESCRIPTION OF THE PREFERRED EMBODIMENTS

Figure 1:
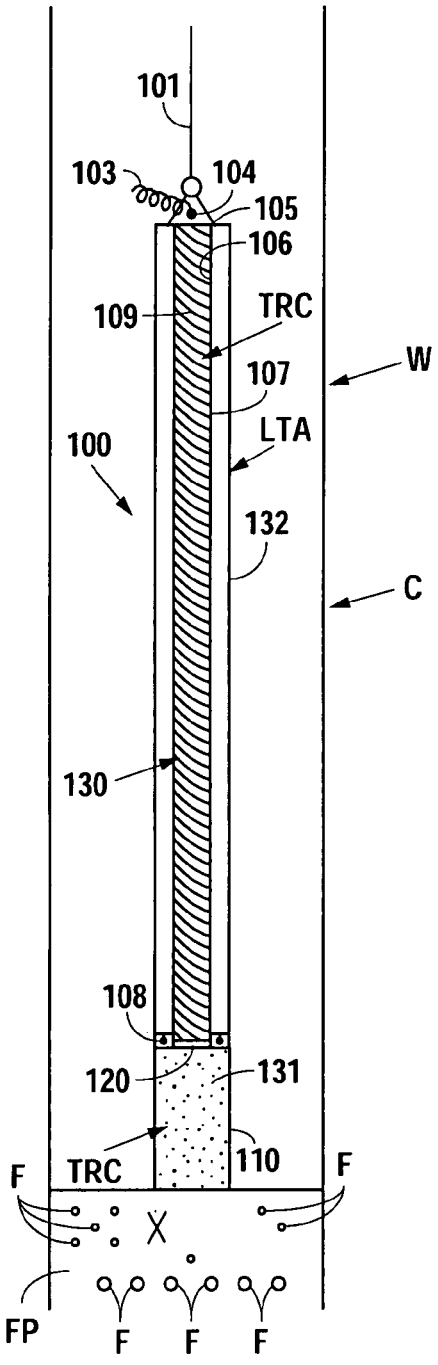
FIG. 1 is a vertical longitudinal sectional schematic view of the secondary plugging tool of the present invention carried into a well on an electric line and positioned just above a first plug previously placed in the well.

Now referring to FIG. 1, there is shown a subterranean well W. The well W includes previously run and set first plug FP. The plug FP contains a number of abrasions, crevices, corrosive spots and electrometric failures, all generally identified as F. These failures F are believed to be the cause of well fluid leaks, previously detected at the top of the well W.

Figure 2:
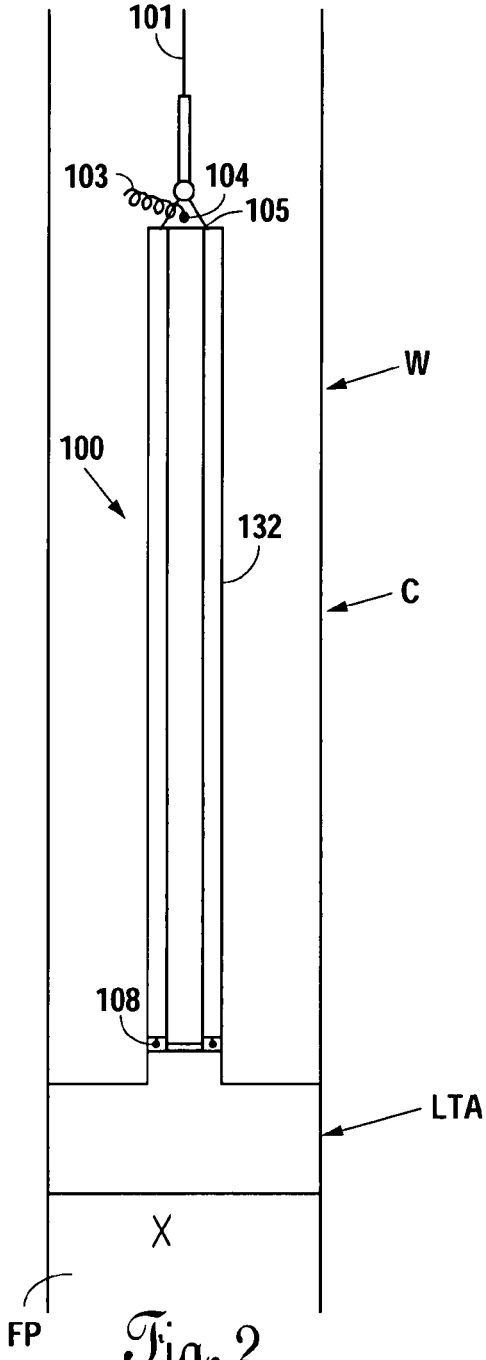
FIG. 2 is a view similar to that of FIG. 1, illustrating the secondary plugging tool after it has been activated with the eutectic alloy charge flowing out of the openings through the lower end of the outer housing and upon the first plug.
Figure 3:
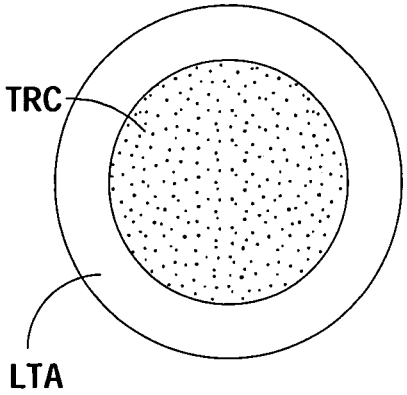
FIG. 3 is an illustration of an alternative design of the present invention wherein the thermitic reaction charge and the eutectic charge are carried within a housing having concentric housing sections.
Figure 4:
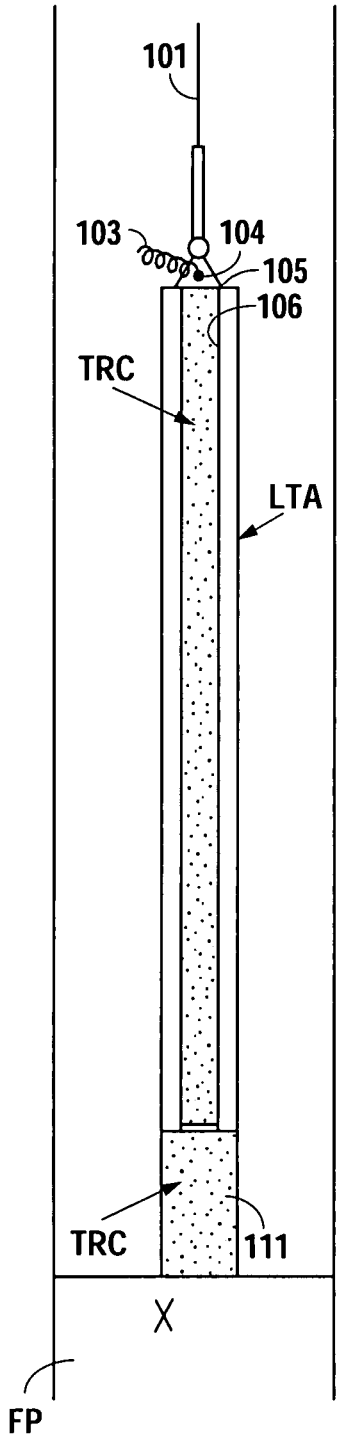
FIG. 4 is a further illustration of yet another alternative preferred embodiment wherein the eutectic metal alloy charge is secured, such as by casting, or the like, to the exterior of a tubular housing containing the thermitic reaction charge.

As shown in FIGS. 1 and 2, the apparatus 100 of the present invention is preferably run into the well W (having casing C) on wire line 101, of conventional and known nature. Alternatively, it may be run into the well W on tubing or electric line. If means other than electric line are used to run and set the apparatus 100, an electric line 103 is provided form the top of the well W and connected to a source of electric energy at the top or other location in the well W and is connected at the lower end to a starter charge 104 within an upper section 105 within an inner tubular housing 106, concentrically positioned within an outer tubular housing member 107. The housing members 106 and 107 preferably are made of metal, such as an alloy steel or the like.

The lower end of the outer housing member 107 is ported, at ports 108. Such ports may be provided by making the wall of the outer housing member 107 very thin in a series of circular or other geometric form, spaced radially around the outer housing member lower end, or even the bottom of the outer housing member 107. If formed in this fashion, the extremely high heat resulting from the ignition of the thermitic reaction charge in the tool 100 will permit these thinned wall portions to give way and open, permitting the eutectic metal alloy charge, described below, in the outer housing to melt and pour through such openings. Alternatively, eutectic plugs may be sealingly placed into openings in the outer housing member 107, such that melting of the eutectic plugs will transpose the plugged openings into the ports.

The inner housing 106 contains a thermitic reaction charge 109, as hereinafter described. The housing 106 is in communication with the lower ends of each of the inner and outer tubular housings 106 and 107 as well as a lower housing 110 having a chamber 111, also containing the thermitic reaction charge. A release joint 120, or a shear pin connection 120, of known construction and commercially available from a number of sources, secures the tubular housings 106 and 107 to the lower housing 110. Alternatively, a meltable or shear release mechanism may be provided between the lower housing 110 and the outer housing 107.

The invention contemplates use of two charges of materials. The first, or lower temperature melting eutectic metallic alloy LTA is deposited into the interior of the outer housing 107. The eutectic composition LTA is an alloy, which, like pure metals, has a single melting point. This melting point is usually lower than that of any of the constituent metals. Thus, for example, pure Tin melts at 449.4 degrees F., and pure Indium melts at 313.5 degrees F., but combined in a proportion of 48% Tin and 52% Indium, they form a eutectic which melts at 243 degrees F. Generally speaking, the eutectic alloy composition LTA of the present invention will be a composition of various ranges of Bismuth, Lead, Tin, Cadmium and Indium. Occasionally, if a higher melting point is desired, only Bismuth and Tin or Lead need be used. The chief component of this composition LTA is Bismuth, which is a heavy coarse crystalline metal that expands when it solidifies. Water and Antimony also expand but Bismuth expands much more than the former, namely 3.3% of its volume. When Bismuth is alloyed with other materials, such a Lead, Tin, Cadmium and Indium, this expansion is modified according to the relative percentages of Bismuth and other components present. As a general rule, Bismuth alloys of approximately 50 percent Bismuth exhibit little change of volume during solidification. Alloys containing more than this tend to expand during solidification and those containing less tend to shrink during solidification. After solidification, alloys containing both Bismuth and Lead in optimum proportions grow in the solid state many hours afterwards. Bismuth alloys that do not contain Lead expand during solidification, with negligible shrinkage while cooling to room temperature. In summary, when reference herein is made to a low temperature alloy composition, or "a low temperature melting eutectic melting metal alloy", we mean to refer to these exemplary compositions and to metallic compositions which melt at temperatures of no more than about 1,100 degrees F.

Most molten metals when solidified in molds or annular areas shrink and pull away from the molds or annular areas or other containers. However, eutectic fusible alloys expand and push against their container when they solidify and are thus excellent materials for use as plugging agents for correcting failure spots in well tubular conduits, such as casing.

The thermitic reaction charge TRC is deposited within a third chamber 130 in the inner housing 106 and within a second chamber 131 in the lower housing 110. A first chamber 132 houses the LTA in outer housing 107. The thermitic reaction materials used to prepare the charge will melt at temperatures of about 2,400 degrees F. or greater. An example of thermite, forming the thermitic reaction charge, is a mixture of powdered or granular aluminum or magnesium metal and powdered iron oxide or other oxides. The reaction is very exothermic. 1.

OPERATION

The apparatus 100 of the present invention is run into the well W on wire line 101 or other means well known to those skilled in the art to a depth just above the top of the first plug FP. The tool or apparatus 100 contains the thermitic reaction charge within the inner housing 106, as well as in the lower housing 110. The low temperature eutectic metal alloy charge LTA has been placed into the outer housing 107. The tool 100 is activated by electric activation through electric signal in electric line 103 to activate the fuel charge 109. The tool 100 may also be activated by a number of other known means such as by percussion means, the dropping of a heavy bar, or the like. Upon activating, the thermitic reaction charge will ignite and the temperature in the chamber outer housing 107 will increase quickly. Upon the outer housing 107 being heated to a temperature in excess of about 1,100 degrees F. i.e. the melting point for the low temperature eutectic metal alloy charge LTA is reached and the eutectic metal alloy charge begins to quickly form a molten mass. The low temperature eutectic charge LTA is permitted to flow through the ports 108, into the well W and pass upon, through and across the exterior of the first plug FP. Upon cooling and solidification of the LTA within the well W, the tool 100 may be retrieved from the well, or left permanently in the well W and the electric line or tubing or the like disengaged from the tool 100 and removed from the well W.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A secondary plugging tool for use in a subterranean well for the repair of a first plug previously introduced into and set within the well, said secondary plugging tool comprising:

(a) an outer tubular housing including a first chamber section, a lower end and a series of circumferentially extending ports immediate the lower end thereof;

(b) a lower housing selectively secured to said outer housing and including a second chamber therein;

(c) an inner tubular housing concentrically positioned within the outer tubular housing and including a third chamber, said second and third chambers being in communication with one another;

(d) a low temperature melting eutectic metal alloy charge deposited within said first chamber;

(e) a thermitic reaction charge deposited within the inner tubular housing immediate and covering said ported lower end;

(f) means secured to at least one of said housings for introducing, positioning and retrieving said plugging tool; and (g) means for igniting the thermitic reaction charge, whereby, upon activation of the igniting means, the thermitic reaction charge is ignited sufficient to heat and thermitically melt the said low temperature melting metal alloy charge, whereby the molten eutectic metal alloy charge flows through the ported lower end of the outer housing and into said well and upon and across said first plug.

2. The well tool of claim 1 further comprising means for releasing the inner and outer housings from the lower housing for retrieval of the inner and outer housings to the top of the well.

3. The well tool of claim 2 wherein the releasing means comprises at least one member shearable upon application of tensile force upon the means for introducing and retrieving the well tool.

4. The well tool of claim 2 wherein the releasing means comprises a meltable metallic connection between the outer and lower housings.

5. The well tool of claim 1 wherein the means for igniting the thermitic reaction charge includes an electric signal.

6. The well tool of claim 1 wherein the means for igniting the thermitic reaction charge includes a percussion element.

7. The well tool of claim 1 wherein the means for igniting the thermitic reaction charge includes a bar element introduced within the inner housing.

8. A method of repairing a first plug set within a subterranean well, comprising the steps of:

(a) introducing into the well on a conduit a well tool, conspiring;

(1) an outer tubular housing including a first chamber section, a lower end and a series of circumferentially extending ports immediate the lower end thereof;

(2) a lower housing selectively secured to said outer housing and including a second chamber therein;

(3) an inner tubular housing concentrically positioned within the outer tubular housing and including a third chamber, said second and third chambers being in communication with one another;

(4) a low temperature melting eutectic metal alloy charge deposited within said first chamber;

(5) a thermitic reaction charge deposited within the inner tubular housing immediate and covering said ported lower end;

(6) means secured to at least one of said housings for introducing, positioning and retrieving said plugging tool;

(7) means for igniting the thermitic reaction charge, whereby, upon activation of the igniting means, the thermitic reaction charge is ignited sufficient to heat and thermitically melt the said low temperature melting metal alloy charge, whereby the molten eutectic metal alloy charge flows through the ported lower end of the outer housing, and into said well and upon and across said first plug; and (b) activating the igniting means to cause the ignition of the thermitic reaction charge in the second and third chambers, whereby during the ignition of the thermitic reaction charge, the eutectic metal alloy charge is transposed into a molten stream which discharges out of the ported lower end of the outer housing, into the well, and across and upon the first plug.

9. The method of claim 8, wherein said tool further comprises releasing means for releasing the inner and outer housings from the lower housing, and further comprising the steps of: (c) activating the releasing means to separate the lower housing from the inner and outer housings; and (d) withdrawing the inner and outer housings from the well prior or subsequent to solidification of the eutectic metal alloy charge across and upon the well plug.

10. A secondary plugging tool for use in a subterranean well for the repair of a first plug previously introduced and set within the well, said secondary plugging tool comprising:

(a) an outer housing;

(b) first and second chamber sections disposed within said housing;

(c) a low temperature melting eutectic metal alloy charge deposited within one of said chamber sections;

(d) a thermitic reaction charge deposited within the other of the first and second chamber section;

(e) means for permitting flow out of the outer housing of the low temperature melting eutectic metal alloy charge upon melting;

(f) means secured to the outer housing for introducing, positioning and retrieving said plugging tool; and (g) means for igniting the thermitic reaction charge, whereby, upon burning of the thermitic reaction charge, the thermite reaction charge melts the low temperature melting eutectic metal alloy charge, whereby, upon said melting of said eutectic metal alloy charge, the molten eutectic metal alloy flows out of outer housing and into said well upon and across said plug.

11. A secondary plugging tool for use in a subterranean well for the repair of a first plug previously introduced into and set within the well, said secondary plugging tool comprising:

(a) a tubular housing having a lower portion;

(b) a low temperature metal alloy charge secured around the exterior of the lower portion of the tubular housing; and (c) a thermitic reaction charge disposed within the tubular housing immediate the lower portion of the housing; and (d) means for permitting the flow of a resulting ignition of the low temperature metal alloy from within the lower portion of the housing and onto the first plug.

12. A secondary plugging tool for use in a subterranean well for the repair of a first plug previously introduced and set within the well, said secondary plugging tool comprising:

(a) an outer tubular housing;

(b) inner, and outer concentrically disposed chamber sections within said housing;

(c) a thermitic reaction charge disposed within said inner chamber section;

(d) a low temperature eutectic metal alloy charge disposed in said outer chamber section and convertible into a molten flow upon ignition of the thermitic reaction charge; and (e) means for permitting flow of the molten eutectic metal alloy charge from within the outer chamber, into the well, and upon and across said plug.

* * * * *